US005970539A

United States Patent [19]

McDermott, Jr. et al.

[11] Patent Number: 5,970,539

[45] Date of Patent: Oct. 26, 1999

[54] MANUAL ZIPPER-DOOR FOR PORTABLE CRIB, PLAYARD OR PLAYPEN

[76] Inventors: Edward Lee McDermott, Jr., 58 Simmons Dr.; Carol Elizabeth McDermott, 58 Simmons Dr., both of Duxbury, Mass. 02332

[21] Appl. No.: 09/111,448

[22] Filed: Jul. 8, 1998

[51] Int. Cl.[6] ..... A47D 7/02; A47D 7/00

[52] U.S. Cl. ..... 5/98.1; 5/100

[58] Field of Search ..... 5/97, 93.1, 94, 5/655, 98.1; 256/25

[56] References Cited

U.S. PATENT DOCUMENTS

| | | | |
|---|---|---|---|
| 2,927,331 | 3/1960 | Ruiz | 5/97 |
| 3,336,608 | 8/1967 | Lerner | 5/98.1 |
| 4,641,387 | 2/1987 | Bondy et al. | 5/97 |
| 5,172,435 | 12/1992 | Griffin et al. | 5/98.1 |
| 5,517,707 | 5/1996 | LaMantia | 5/97 |

FOREIGN PATENT DOCUMENTS

| | | | |
|---|---|---|---|
| 453244 | 12/1948 | Canada | 5/98.1 |

*Primary Examiner*—Alexander Grosz
*Attorney, Agent, or Firm*—Samuels, Gauthier & Stevens

[57] ABSTRACT

A manually operated zipper-door comprised of a zipper and zipper track positioned on the side of a playpen and incorporated into the existing material of the playpen. The zipper-door, with the zipper located on the outside, allows one to safely and easily place a child into or remove a child from the side of a playpen. In addition, the child placed into the playpen is unable to operate the zipper-door for when the door is closed, the zipper is located at the bottom corner of the door.

2 Claims, 1 Drawing Sheet

MANUAL ZIPPER-DOOR FOR PORTABLE CRIB, PLAYARD OR PLAYPEN

BACKGROUND OF THE INVENTION

This invention relates to a manual zipper-door (hereinafter zipper-door) for a portable crib, playard, or playpen (hereinafter playpen designates all three), designed to be used on either lengthwise sides of a rectangular, or any side of a square playpen.

The repeated action of lowering and raising a child into and from a playpen by way of the only current opening, the top, often causes lower back pain in the one moving the child.

The door affords one the alternative of removing a child from or placing a child into a playpen from the side, thus eliminating the common problem of back strain attendant to the same procedure performed from the top of the playpen.

SUMMARY OF THE INVENTION

The door is positioned on either lengthwise side of a rectangular, or any side of a square playpen and incorporated into the design of the playpen; to wit, the zipper and zipper track made of metal, alloy, or plastic can be sewn, or adhered by some other method, into the material of the side of the playpen. If necessary, a strip of additional fabric or suitable material may be sewn or adhered by some other method, into the existing material of the playpen to border the zipper track and reinforce the existing fabric.

In order to ensure that a child placed in the playpen cannot operate the door, the zipper is located on the outside. The proper operation of the zipper-door entails manually moving the zipper from the bottom left corner (or tight corner) of the door on the outside of the playpen and following the zipper tack, a nearly rectangular track with the top corners rounded to facilitate the travel of the zipper, and ending at the bottom right corner (or left corner).

DETAILED DESCRIPTION OF THE INVENTION

Figure 1A:
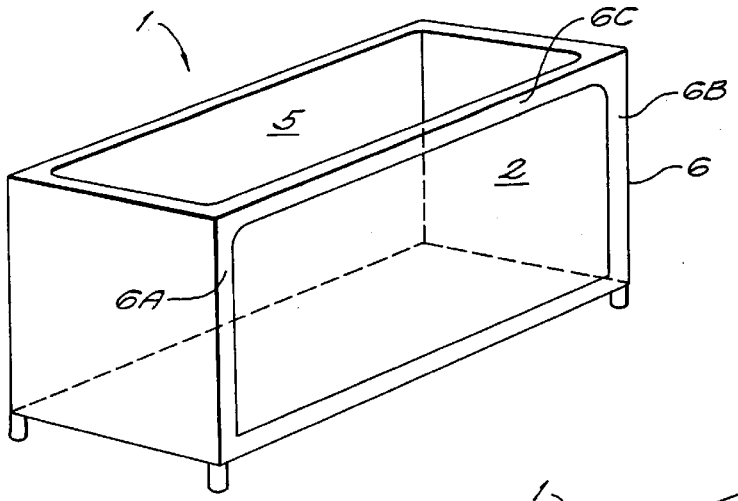
FIG. 1A is a perspective view of the zipper-door located on one of two lengthwise sides of a rectangular playpen.
Figure 1B:
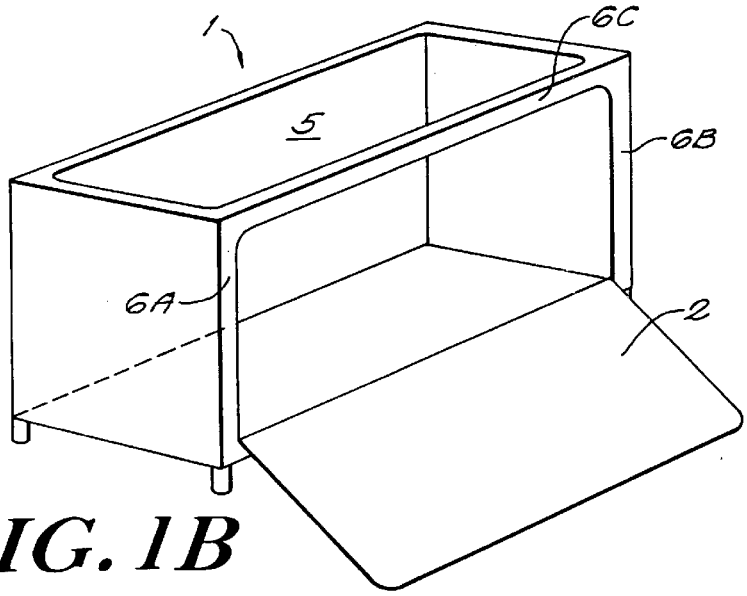
FIG. 1B is a perspective view of the playpen with the door in the open position.

Referring to FIGS. 1A and B, a playpen is shown at 1. A disengageable flap or door 2 is shown in both closed and open positions on side 6 of the playpen, When the door is in the open position, portions of the side, such as sections 6A and 6B along with a section along the top edge 6C, remain in position. The door 2 may be located on either one of two lengthwise sides of rectangular playpen 1. A child may be placed into the playpen or removed from it by way of the door or alteratively through the open top 5.

Figure 2:
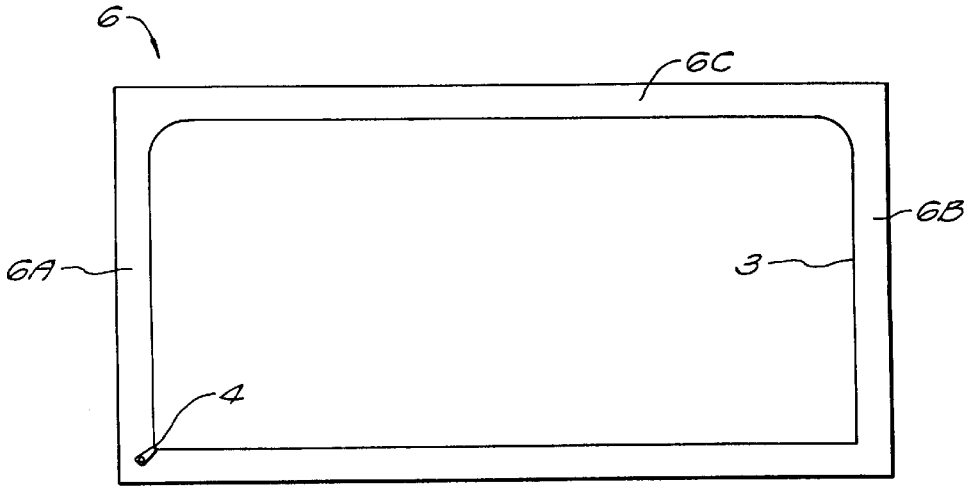
FIG. 2 is an enlarged plan view of the zipper-door of FIG. 1A.

Referring to FIG. 2, the door is opened manually by grasping a zipper 4 located at the lower left corner (closed position) on the outside of one of two lengthwise sides of the rectangular playpen 1 and moving the zipper along the zipper track 3, thus terminating at the lower right corner (open position) of the door on the outside of the playpen. The open and closed positions may also be reversed depending upon the situation of the zipper on the zipper track determined at the time the door is incorporated into the manufacture of the playpen.

While there has been shown and described a preferred embodiment of the door, it is understood that changes in materials, sizes, and shapes can be made by those accomplished in the craft without departing from the invention.

What is now claimed is:

1. A playpen having two openings for placing a child into and removing a child therefrom; said playpen comprising:

a housing having four sides, a bottom and a first opening along the top thereof; and a disengageable flap including a zipper located in one of the sides of the housing which may be maneuvered to and from open and closed positions such that when said flap is in an open position, a portion of the side remains in position including a section along the edges and top thereof, and wherein said flap is lowered a second opening is created in said playpen.

2. The playpen of claim 1, wherein said zipper is comprised of metal, alloy or plastic.

* * * * *